US007093737B2

(12) United States Patent
Tramontina et al.

(10) Patent No.: US 7,093,737 B2
(45) Date of Patent: Aug. 22, 2006

(54) CONTAINER AND CARTRIDGE FOR DISPENSING PAPER PRODUCTS

(75) Inventors: Paul Francis Tramontina, Alpharetta, GA (US); Randall W. LeCates, Monroeville, NJ (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 402 days.

(21) Appl. No.: 10/657,386

(22) Filed: Sep. 8, 2003

(65) Prior Publication Data

Related U.S. Application Data

(60) Provisional application No. 60/463,209, filed on Apr. 16, 2003.

(51) Int. Cl.
*B65H 1/00* (2006.01)

(52) U.S. Cl. ..... 221/46; 221/52; 221/56; 221/59; 221/198

(58) Field of Classification Search ..... 221/46, 221/52, 59, 56, 198, 279; 312/61, 71
See application file for complete search history.

(56) References Cited

U.S. PATENT DOCUMENTS

| | | | | | |
|---|---|---|---|---|---|
| 557,553 | A | * | 4/1896 | Chillberg | 221/59 |
| 813,594 | A | | 2/1906 | Sexton | |
| 1,072,859 | A | | 9/1913 | Kingsley | |
| 1,293,291 | A | * | 2/1919 | Albig | 221/34 |
| 1,362,449 | A | | 12/1920 | Teall | |
| 1,525,040 | A | | 2/1925 | Painter | |
| 1,579,429 | A | | 4/1926 | Arms | |
| 1,785,039 | A | | 12/1930 | McCorkindale | |
| 2,253,742 | A | | 8/1941 | West et al. | |
| 3,095,996 | A | * | 7/1963 | Babin | 221/52 |
| 3,343,716 | A | | 9/1967 | Peebles | |
| 3,425,595 | A | | 2/1969 | Shapira | |
| 3,498,688 | A | | 3/1970 | Long et al. | |
| 3,647,114 | A | | 3/1972 | Bleuer | |
| 3,726,435 | A | | 4/1973 | Williams et al. | |
| 3,823,845 | A | | 7/1974 | Mott, Sr. et al. | |
| 4,094,442 | A | | 6/1978 | Radek | |
| 4,126,248 | A | * | 11/1978 | House | 221/241 |
| 4,234,101 | A | * | 11/1980 | Pastore | 221/241 |
| 4,343,415 | A | | 8/1982 | Radek | |
| 4,706,844 | A | | 11/1987 | Omdoll | |
| D296,064 | S | | 6/1988 | Omdoll | |

(Continued)

FOREIGN PATENT DOCUMENTS

| | | |
|---|---|---|
| CH | 344824 | 2/1960 |

(Continued)

*Primary Examiner*—David H. Bollinger
(74) *Attorney, Agent, or Firm*—Richard M. Shane; Nathan P. Hendon

(57) ABSTRACT

The present invention provides a container for dispensing individual paper products that includes a housing, a cover hingedly or removably attached to the housing wherein the cover defines a dispensing opening, a means for elevating paper products, and a plunger disposed in the interior area of the housing. The plunger is urged toward the dispensing opening by the means for elevating paper products. The container may be included in a system for dispensing paper products that further includes a cartridge containing paper products. The cartridge defines a dispensing opening and a second opening wherein the means for elevating paper products extends through the second opening into the interior area of the cartridge to contact the paper products and urge the paper products toward the dispensing opening.

25 Claims, 6 Drawing Sheets

U.S. PATENT DOCUMENTS

| | | | | |
|---|---|---|---|---|
| 4,830,354 | A * | 5/1989 | Penson | 271/147 |
| 4,838,454 | A * | 6/1989 | Salzmann et al. | 221/57 |
| 4,969,575 | A | 11/1990 | Kobayashi | |
| 5,143,250 | A * | 9/1992 | Freitag | 221/59 |
| 5,540,354 | A | 7/1996 | Annand | |
| 5,931,339 | A | 8/1999 | Dodge et al. | |
| 6,241,118 | B1 | 6/2001 | Tramontina | |
| 6,283,295 | B1 | 9/2001 | Akutagawa et al. | |
| 6,378,726 | B1 | 4/2002 | Chan et al. | |
| 6,419,113 | B1 | 7/2002 | Tramontina | |
| 6,422,416 | B1 | 7/2002 | Tramontina | |
| 6,772,908 | B1 * | 8/2004 | Roethel et al. | 221/279 |

FOREIGN PATENT DOCUMENTS

| | | |
|---|---|---|
| CH | 368913 | 4/1963 |
| DE | 8911997 | 11/1989 |
| WO | WO 99/30601 | 6/1999 |
| WO | WO 00/33713 | 6/2000 |

* cited by examiner

CONTAINER AND CARTRIDGE FOR DISPENSING PAPER PRODUCTS

RELATED APPLICATIONS

The present application claims priority to U.S. Provisional Application Ser. No. 60/463,209, filed on Apr. 16, 2003.

BACKGROUND OF THE INVENTION

Various types of dispensers for paper products have been developed to provide ready availability of the paper products to users. Such dispensers are often provided in public places such as restaurants or rest rooms where customers remove from the dispenser a desired amount of paper products for personal use. In some high traffic areas, such as fast food restaurants, a large number of customers may use a paper product dispenser such as a napkin dispenser in a short period of time. Therefore, dispensers have been developed that hold a large number of paper products for use by a large number of consumers.

For many applications, it is desirable to have a large dispenser that is embedded in a countertop. This is particularly desirable when open counter space above the countertop is needed for visibility or other reasons. Unfortunately, large recessed dispensers are subject to a number of drawbacks. First, because access to the body of the dispenser is limited by the structure supporting the countertop, it can be difficult to load large quantities of napkins into a recessed dispenser. Second, if paper products are not properly loaded into the dispenser, the paper products may jam as they are removed thereby preventing further removal of paper products by users. Third, a person refilling a large dispenser is more likely, due to the larger number of paper products involved, to drop some of the paper products onto a floor. Any dropped paper products are then unsanitary and must be discarded, thereby creating more waste and defeating certain benefits of the larger dispenser.

Therefore, there is a need for large inverted and/or recessed dispensers that reduce the incidence of waste of paper products due to dropping of the paper products during refilling of the container. There is likewise a need for such dispensers that reduce the incidence of jamming of paper products and the resultant inability to dispense further paper products, and further that supports the weight of paper products and moves the paper products toward the dispenser opening so that individual paper products are readily removed.

SUMMARY OF THE INVENTION

The aforesaid needs are fulfilled and the problems experienced by those skilled in the art overcome by the container for dispensing individual paper products of the present invention. In one embodiment, the container includes a housing having side walls and a bottom wall defining an interior surface and an interior area within the interior surface. The container further includes a cover hingedly or removably attached to the housing wherein the cover defines a dispensing opening. Within the interior area of the housing there is a spring and a plunger. The spring is compressed between the plunger and at least one of the walls. The plunger is urged toward the dispensing opening by the spring.

In one aspect, the plunger may have the shape of a truncated cone. Desirably, the truncated cone may include a bottom surface having a diameter substantially equivalent to the diameter of the spring.

In a further aspect, the plunger may include at least one stabilizing wing. Desirably, the stabilizing wing has an outer edge that contacts the inside surface of the housing to prevent the plunger from binding in the housing.

In one aspect, the container may include an internal platform in contact with the plunger. The internal platform may be positioned between the plunger and paper products in the container and acts to urge the paper products toward the dispensing opening. Desirably, the internal platform applies substantially constant pressure against the paper products. In a further aspect, the internal platform may include notches to minimize contact of the internal platform with the internal surface of the housing.

In another embodiment, a system for dispensing individual paper products includes the container described above and a cartridge containing paper products within the container. The cartridge defines a second opening adapted for receiving the plunger wherein the plunger extends through the second opening into the interior area of the cartridge to contact the paper products and urge the paper products toward the dispensing opening. The cartridge may include cartridge side walls, a first end wall defining a dispensing opening for dispensing the paper products, and a second end wall opposing the first end wall, wherein the second opening is defined by the second end wall. In one aspect, the cartridge may further include a removable portion, removal of the removable portion creating the second opening. In a further aspect, the removable portion may include at least one flap.

In one aspect, the cartridge may further include an internal platform that engages the plunger. In a further aspect, the cartridge may further include platform supports that support the internal platform within the cartridge when the cartridge is being inserted in the housing.

In another aspect, the container may include tabs positioned on the interior surface of the housing. Further, the cartridge may define slots positioned to engage the tabs to prevent insertion of the cartridge when the cartridge is improperly oriented. In one embodiment, the slots are defined within a side wall of the cartridge. In an alternate embodiment, the slots are defined within flaps that open to receive the plunger. When the flaps are open, the slots are positioned to engage the tabs when the cartridge is improperly oriented.

In another embodiment, the container described above may be positioned within a supporting structure. Desirably, the container may be supported within the supporting structure by flanges intersecting the side walls at the edges farthest from the bottom wall. Even more desirably, the container is oriented such that paper products are urged toward the dispensing opening in a substantially vertical direction. In one aspect, the cover is flush with the supporting structure. Alternatively, the cover may extend slightly from the supporting structure.

In another embodiment, a container for dispensing individual paper products includes a housing including side walls and a bottom wall defining an interior surface and an interior area within the interior surface for receiving a plurality of the paper products. The container further includes a cover hingedly or removably attached to the housing wherein the cover defines a dispensing opening, a means for elevating paper products, and a plunger disposed in the interior area of the housing wherein the means for elevating paper products is positioned between the plunger and at least one of the walls, and further wherein the plunger is urged toward the dispensing opening. In one aspect, the container may be included in a system for dispensing paper products that further includes a cartridge containing paper products. The cartridge defines a dispensing opening and a second opening wherein the means for elevating paper products extends through the second opening into the interior area of the cartridge to contact the paper products and urge the paper products toward the dispensing opening.

Other features and aspects of the present invention are discussed in greater detail below.

BRIEF DESCRIPTION OF THE DRAWINGS

The present invention will be more fully understood from the following detailed description, taken in conjunction with the accompanying drawings (not to scale), wherein like reference numerals refer to like parts, and in which.

DETAILED DESCRIPTION

Figure 1:
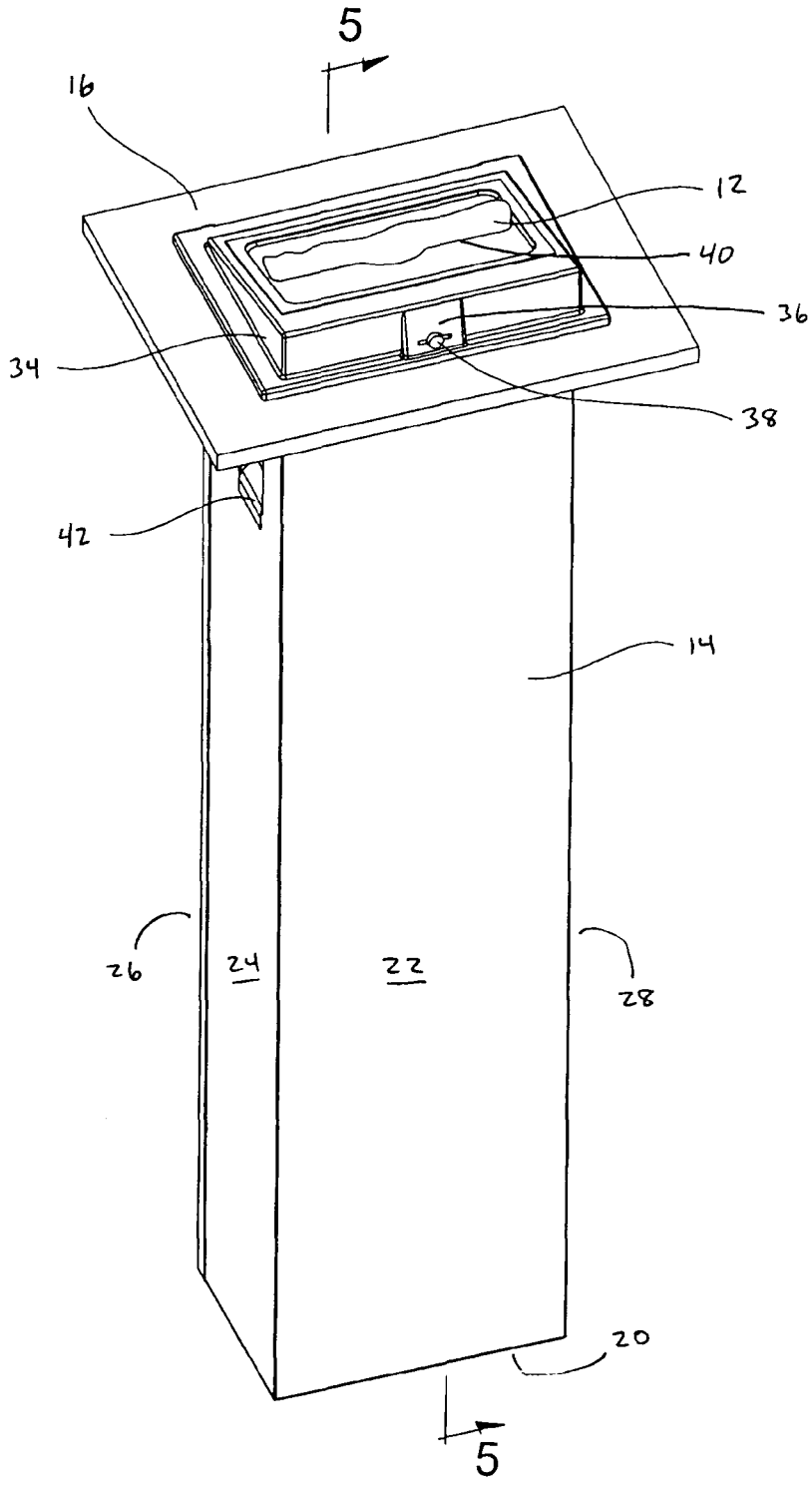
FIG. 1 is a perspective view of an exemplary container for dispensing paper products.

Reference will now be made in detail to various embodiments of the invention, one or more examples of which are illustrated in the drawings (not to scale). Each example is provided by way of explanation of the invention and not meant as a limitation of the invention. For example, features illustrated or described as part of one embodiment or figure can be used on another embodiment or figure to yield yet another embodiment. It is intended that the present invention include such modifications and variations.

The present invention is directed to a container for dispensing sheet-like materials. Various sheet-like materials can be dispensed from the container of the present invention such as, for example, paper, nonwoven, and other products. Exemplary sheet-like products include, but are not limited to, facial tissue, towels, bathroom tissue, wipers, napkins, seat covers and so forth. The specific composition of the sheet materials dispensed can vary as desired. Exemplary sheet-like materials and methods of making the same include, but are not limited to, those described in U.S. Pat. Nos. 3,301,746; 3,322,617; 3,650,882; 4,100,324; 4,436,780; 4,659,609; 4,737,393; 5,048,589; 5,284,703; 5,399,412; 5,494,554; 5,607,551; 5,672,248; 5,716,691; 5,772,845; 5,776,306; 6,077,590; 6,273,996; 6,096,152 and so forth. While paper products are generally discussed with regard to the embodiments described herein below, it will be understood that various other products could be substituted therefore.

The container of the present invention can hold and dispense significant numbers of individual sheets. Desirably, the container is sized to hold and dispense at least about 250 sheets. By way of example, the container can contain between about 400 and about 1000 sheets. In certain embodiments, the container can contain and dispense between about 700 and about 900 sheets.

Referring to FIG. 1, a container 10 is disclosed for dispensing paper products 12. The container 10 includes a housing 14 in which the paper products 12 are placed and from which the paper products 12 are dispensed. Optionally, the paper products 12 may be contained within a cartridge which is placed within the housing 14. The container can be positioned in a vertical or horizontal orientation either alone or within a supporting structure or surface. In one embodiment, the container is installed in a countertop 16 or other suitable substantially planar surface.

The housing 14 includes a bottom wall 20 and a number of side walls including a first side wall 22, a second side wall 24, a third side wall 26, and a fourth side wall 28 for housing the paper products 12. The side walls 22, 24, 26, 28 intersect the bottom wall to define an interior surface 30 (see FIG. 2) of housing 14, within which an interior area 32 (see FIG. 2) is located. The side walls 22, 24, 26, 28 and the bottom wall 20 may each, if desired, be made of two or more planar portions. Such construction strengthens the housing 14 and is useful in locations where the housing might be vandalized. The outer portions of the side walls 22, 24, 26, 28 help withstand any blow or impact to the housing 14 to prevent destruction of the housing, removal of the housing from its mounting, or removal of paper products 12 from the housing.

The container 10 further includes a cover 34 which is removably or hingedly attached to one of the side walls 22, 24, 26, 28. The cover 34 may be flush with or extend slightly from the countertop 16 or other surface in which the container 10 is installed. The cover 34 is openable for insertion of paper products 12 into the interior area of the housing 14 when the supply of paper products 12 is depleted and/or runs low. Desirably, the cover 34 includes one or more fasteners 36 that hold the cover closed. As used herein, the term "fasteners" means devices that fasten, join, connect, secure, hold, or clamp components together. Fasteners include, but are not limited to, hooks, hook and eye fasteners, latches, snaps, snap-fits, clips, clasps, loop fasteners, interlocking male/female connectors, fishhook connectors, and so forth. The fastener 36 is openable when desired to reopen the cover 34. In one embodiment, the fastener 36 is openable by pressing a button 38. The cover 34 defines a dispensing opening 40 through which the paper products 12 pass as they are dispensed.

Desirably, at least one protrusion extends into the interior area of the housing. In one embodiment, as partially shown in FIG. 1, the second side wall 24 and the fourth side wall 28 include protrusions 42 extending into the interior area of the housing 14. However, the protrusions 42 could be disposed on any of the walls and one wall can have multiple protrusions. In those embodiments wherein pairs of protrusions are disposed on opposing walls of the housing 14, they can be disposed at the same height or different heights (i.e., staggered). The protrusions 42 desirably comprise a generally downwardly angled structure and can have a geometric and/or curvilinear structure. By way of example only, the protrusions can comprise curved bumpers that may include a plurality of ridges extending across the curved bumpers perpendicular to the dispensing direction. The protrusions 42 extend into the interior area 32 to contact paper products 12 and thereby oppose the movement of paper products 12 in the dispensing direction. By extending into the interior area 32 to contact paper products 12, the protrusions 42 impede the movement of paper products 12 toward the dispensing opening, but do not prohibit such movement. The use of protrusions to control dispensing is described, for example, in U.S. Pat. No. 6,241,118 to Tramontina and U.S. Pat. No. 6,378,726 to Chan et al., the entire contents of which are incorporated herein by reference thereto.

Figure 2:
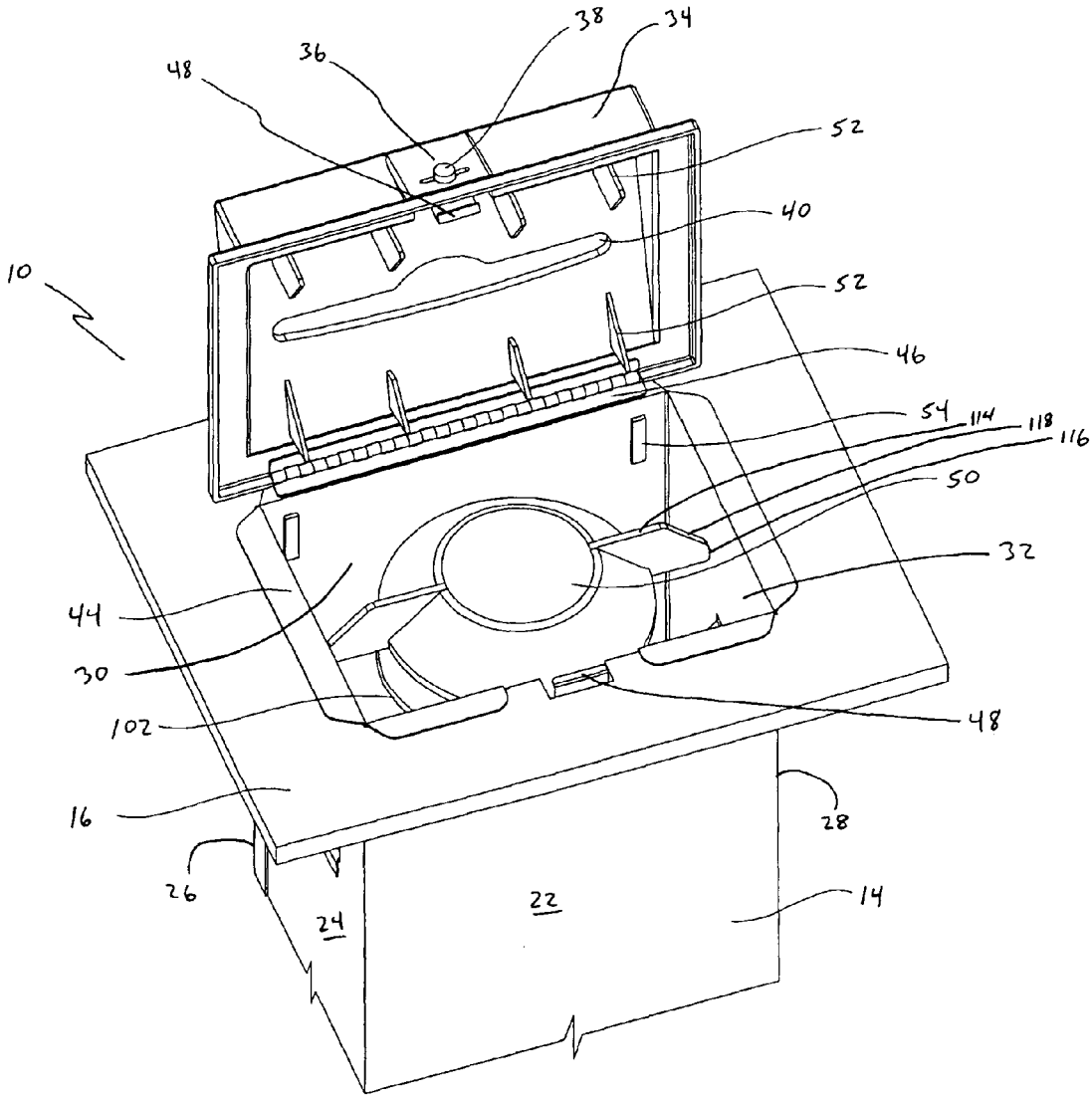
FIG. 2 is a perspective view of the open container of FIG. 1.

Referring now to FIG. 2, the housing 14 is supported within the countertop 16 by flanges 44 that extend outwardly from the side walls 22, 24, 26, 28. When the housing 14 is inserted in an opening in the countertop 16 slightly larger than the cross-section of the housing 14, the housing is supported within the countertop by the flanges 44. Desirably, the flanges 44 intersect the side walls 22, 24, 26, 28 at the edges farthest from the bottom wall 20. This allows the container 10 to be seated substantially flush with the surface of the countertop 16. The flanges may be fastened to the countertop or other surface by suitable fastening devices. Suitable fastening devices include, but are not limited to, screws, nuts and bolts, rivets, snap-fits, tacks, nails, adhesives, and so forth.

As noted above, the cover 34 may be hingedly attached to one of the side walls 22, 24, 26, 28 by a hinge 46. As used herein, the term "hinge" refers to a jointed or flexible device that connects and permits pivoting or turning of a part to a stationary component. Hinges include, but are not limited to, pivotable connectors, such as those used to fasten a door to frame, and living hinges. Living hinges may be constructed from plastic and formed integrally between two members. A living hinge permits pivotable movement of one member in relation to another connected member. The cover 34 is openable for insertion of paper products 12 into the interior area 32 of the housing 14 when the supply of paper products is depleted and/or runs low. The fastener 36 that holds the cover 34 closed may, for example, include interlocking tabs 48. At least one of the interlocking tabs 48 is movable when desired to reopen the cover 34 by pressing the button 38. Any other type of fastener 36 known to those skilled in the art for reopenably securing the cover 34 may be used.

Figure 5:
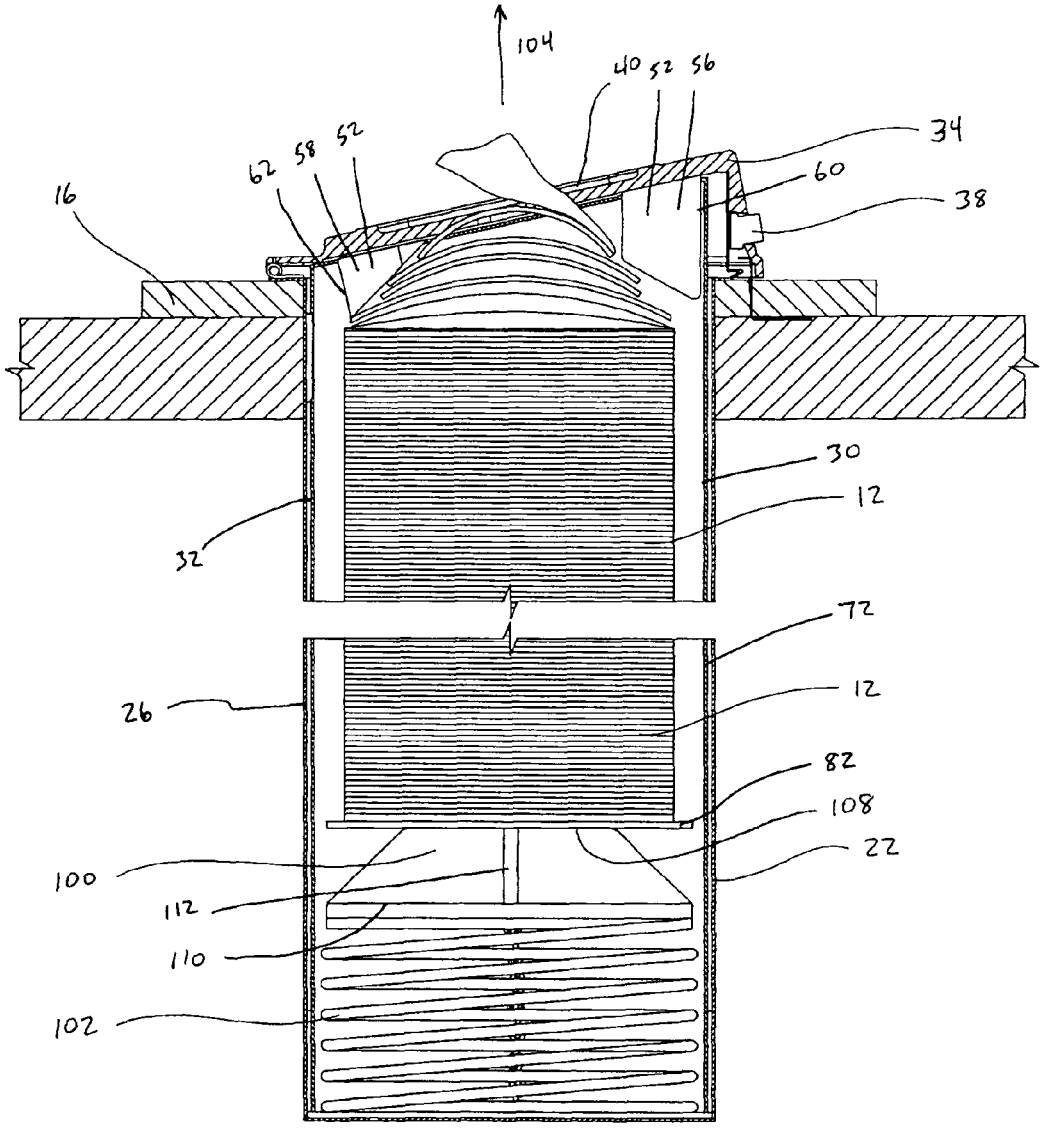
FIG. 5 is a cross-sectional view of the container of FIG. 1 taken along line 1—1 of FIG. 1.

Desirably, the cover 34 further includes a group of control ribs 52 that extend into the interior area 32 to contact paper products when the cover is in the closed position. The control ribs 52 space, slow, align, and/or support paper products as the same are moved toward the cover 34 and through the dispensing opening 40. Size, shape, and spacing of the control ribs can be used to control dispensing of the paper products. Referring now to FIG. 5, the control ribs 52 may have different dimensions to properly support and guide the paper products into the dispensing opening 40. For example, a tall rib member 56 extends into the interior area 32 by a greater amount than a short rib member 58. The tall rib members 56 and short rib members 58 are illustrated to show an exemplary dispensing configuration. Additionally, a side surface 60 of the tall rib member 56 closest to the interior surface 30 may be configured so there is little or no offset from the interior surface. A side surface 62 of the short rib member 58 may be offset from the interior surface 30 by a greater amount.

As one example, the tall rib member 56 may have a height ranging from about 1 to about 2 inches at the location where it intersects with the first side wall 22 and an offset or height ranging from about 0.1 to about 0.5 inch adjacent the dispensing opening 40. The short rib member 58 may have a height ranging from about 0.5 to about 1.5 inch at the location where it intersects with the third side wall 26 and an offset or height ranging from 0 to about 0.25 inch adjacent the dispensing opening 40. The rib members may have various widths or thicknesses and the width of a rib member may vary along any dimension or dimensions. Desirably, the portion of the rib member contacting the paper product will be relatively thin and smooth to minimize friction. The use of rib members is further described in U.S. Pat. No. 6,241,118 to Tramontina and PCT Publication WO 99/30601, the entire contents of which are incorporated herein by reference.

Referring again to FIG. 2, the container 10 further includes a means for elevating paper products 50 toward the dispensing opening 40 in the cover 34. Various alternatives are possible within the scope of the invention to elevate paper products toward the cover 34. The means for elevating paper products 50 may comprise any structure that allows paper products to be urged toward and dispensed from the dispensing opening 40 in the cover 34. The means for elevating paper products 50 is discussed more fully below in conjunction with FIG. 5.

The dispensing opening 40 may have many shapes within the scope of the present invention, as long as the opening provides easy access for a user. Optionally, the dispensing opening may also be configured to provide metered delivery of individual paper products. Desirably, the paper products 12 are interfolded, tabbed, or tab interfolded to provide metered feeding of individual paper products one at a time. Folding devices, such as boards or plates, have long been used to longitudinally fold webs and other sheet-like materials in order to form a stack of folded sheets. The sheets are, generally speaking, drawn over the folding device wherein the shape and configuration of the device causes the sheet to twist and bend thereby producing the desired fold. Folding devices have heretofore been provided in a variety of shapes and configurations in order to achieve the desired fold lines and folding patterns. Folding devices have been used to form a number of different folds including, for example, half-folds, quarter folds, c-folds, v-folds, j-folds, w-folds, z-folds, and so forth.

In addition, for more complex folds requiring multiple fold lines, it is known to form the necessary fold lines using two or more folding devices in series. In this regard, folding boards have also been used in series to achieve inter-folded or inter-leafed sheets, that is to say sheets folded such that they partially envelope portions of another sheet. Inter-leafed sheets are commonly employed in stacks as a mechanism to facilitate removal of the individual sheets from a dispenser. Withdrawal of a first sheet through a dispenser opening pulls the enveloped portion of a second sheet through the dispenser opening such that it extends out of the dispenser opening and is exposed. Having a portion of the subsequent sheet extending out of the dispenser opening greatly facilitates removal of the same from the dispenser by the user. By way of example only, various folding devices, folding patterns and inter-folding schemes are described in the following U.S. Pat. Nos. 3,401,928; 3,679,094; 3,817,514; 3,841,620; 4,131,271; 4,502,675; 5,868,276; 6,045,002; and 6,168,848. However, the present invention does not require the use of interfolded paper products.

Optionally, the housing 14 may include one or more tabs 54 attached to the interior surface 30 near the opening in the housing 14 through which paper products are loaded. The tabs 54 are dimensioned such that they inhibit a cartridge containing paper products from being loaded in an improper orientation. The tabs 54 align with slots in a cartridge such that the slots will catch on the tabs 54 if the cartridge is not oriented properly prior to loading the cartridge into the housing 14. When the cartridge is aligned properly, there are no slots to catch on the tabs 54 and the cartridge will slide into the housing 14 unimpeded.

The housing 14 may be made from numerous materials and by numerous methods known to those skilled in the art. The housing 14 may be made of plastic such as polyethylene, nylon, and so forth. However, other suitable materials, such as other plastics or metals, may be provided for any or all of the parts of the housing 14. As one example, the housing 14 may be made of an injection-molded plastic. The protrusions 42, control ribs 52, and tabs 54 are desirably formed integral with the housing 14. However, the protrusions 42, control ribs 52, and tabs 54 may be formed separately from the housing 14 and attached later. Also, the protrusions 42, control ribs 52, and tabs 54 may be made of different material from the housing 14 if desired. For example, the protrusions 42, control ribs 52, and tabs 54 may be made of a more resilient material than the materials described above, such as an elastomer or rubber.

Figure 3:
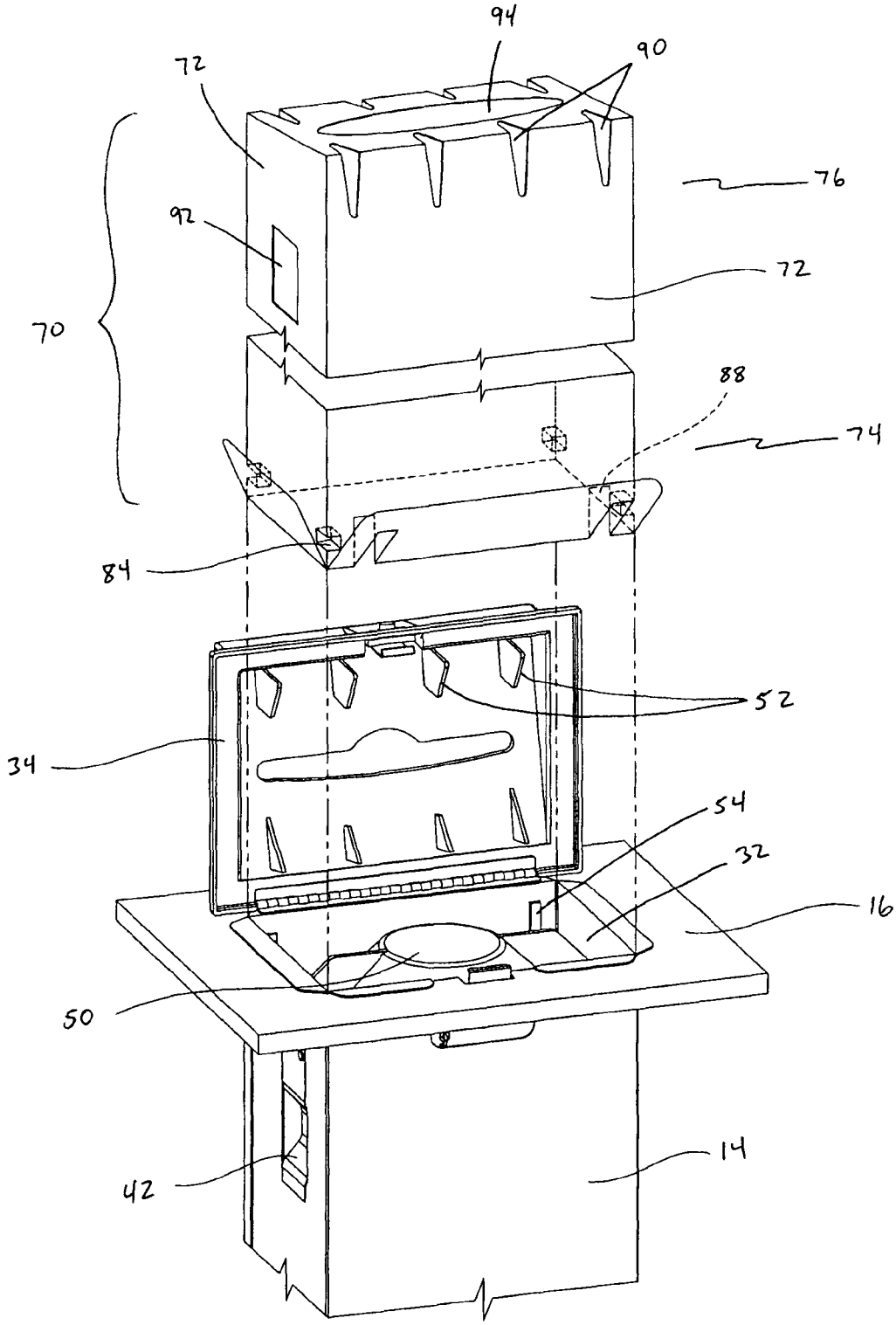
FIG. 3 is an exploded perspective view of the container and cartridge of FIG. 2 with the cartridge inserted into the container.

Desirably, as mentioned above, a cartridge may be provided for holding paper products to be dispensed to a user. As shown in FIG. 3, a cartridge 70 having outside walls 72 is provided for insertion into the interior area 32 of the housing 14 for containing paper products 12 to be dispensed. The cartridge has a bottom end 74 that is adapted to receive the means for elevating paper products 50 and a top end 76 adapted to dispense paper products 12. The cartridge 70 is sized to fit within the interior area 32 of the housing 14. Desirably, the cartridge 70 is sized to be only slightly smaller than the housing 14 to maximize the number of paper products 12 contained within the cartridge.

The cartridge 70 can hold and dispense significant numbers of individual sheets. Desirably, the cartridge 70 is sized to hold and dispense at least about 250 sheets. By way of example, the cartridge 70 can contain between about 400 and about 1000 sheets. In certain embodiments, the cartridge 70 can contain and dispense between about 700 and about 900 sheets.

Desirably, the cartridge includes a plurality of removable portions, the removal of which creates openings through the cartridge. One such removable portion may disposed at the bottom end of the cartridge. Removal of the removable portion at the bottom end of the cartridge allows the cartridge to receive the means for elevating paper products when the cartridge is loaded into the housing. Alternatively, the removable portion may be flaps which can be folded back to create an opening. As shown in FIG. 3, the cartridge 70 includes one or more flaps 80 disposed in the bottom wall of the cartridge 70. The flaps 80 are folded back prior to loading the cartridge 70 into the housing 14. Folding back the flaps 80 allows the cartridge 70 to receive the means for elevating paper products 50.

Desirably, the cartridge includes at least one removable portion that can be removed to create a slot 88 that, as discussed above, will prevent misalignment of the cartridge in the housing. The slots 88 are positioned such that when the cartridge is improperly oriented, the slots will catch on tabs 54 positioned on the interior surface of the housing. The slots 88 may be positioned in one of the outside walls 72 of the cartridge 70. Alternatively, the slots 88 may be positioned in the flaps 80 that are opened prior to insertion of the cartridge 70 in the housing 14. When the flaps 80 are opened, they fold back against the outside walls 72 of the cartridge 70 where the slots 88 would be in position to engage the tabs 54 if the cartridge is not oriented correctly.

The cartridge 70 may include at least one of another removable portion at the top end 76 of the cartridge 70 so that paper products 12 can be supported and aligned by the control ribs 52 for dispensing through the dispensing opening 40. Removal of the removable portions creates openings 90 through which the control ribs 52 extend.

The cartridge 70 may include at least one of another removable portion that corresponds to the protrusions 42 in the housing 14. The removable portions are disposed in the outside walls 72 of the cartridge 70 so that, once the removable portions are removed, openings 92 can encompass and receive the protrusions 42 extending from the interior surface 30 of the housing 14. Thus, upon removal of the removable portions and placement of the cartridge 70 in the housing 14, the protrusions 42 and rib members 58 contact the paper products 12 within the cartridge 70 and act upon the paper products as described above.

The top end 76 of the cartridge 70 may be formed having a removable portion corresponding to the dispensing opening 40. Removal of this removable portion creates an opening 94 through which the paper products are dispensed.

The removable portions may either be removed (or simply not formed) during manufacture of the cartridge or removed just prior to installation of the cartridge in the housing. If the removable portions are to be removed as part of the manufacturing process, the cartridge should be shipped to the user wrapped, for example in a polyethylene bag, to preserve the sterility of the paper products in the cartridge. If the removable portions are to be removed as part of the installation process, the edges of the removable portions should be weakened, scored, etc. for easy removal. If a removable portion is used to provide access for the means for elevating the paper products, it should not be removed as part of the manufacturing process to ensure that the paper products remain properly loaded in the cartridge 70 until the time at which the cartridge is to be inserted in the housing 14.

The cartridge 70 is desirably made of heavy paper or cardboard, but may be made of any other suitable material known to those skilled in the art.

Figure 4:
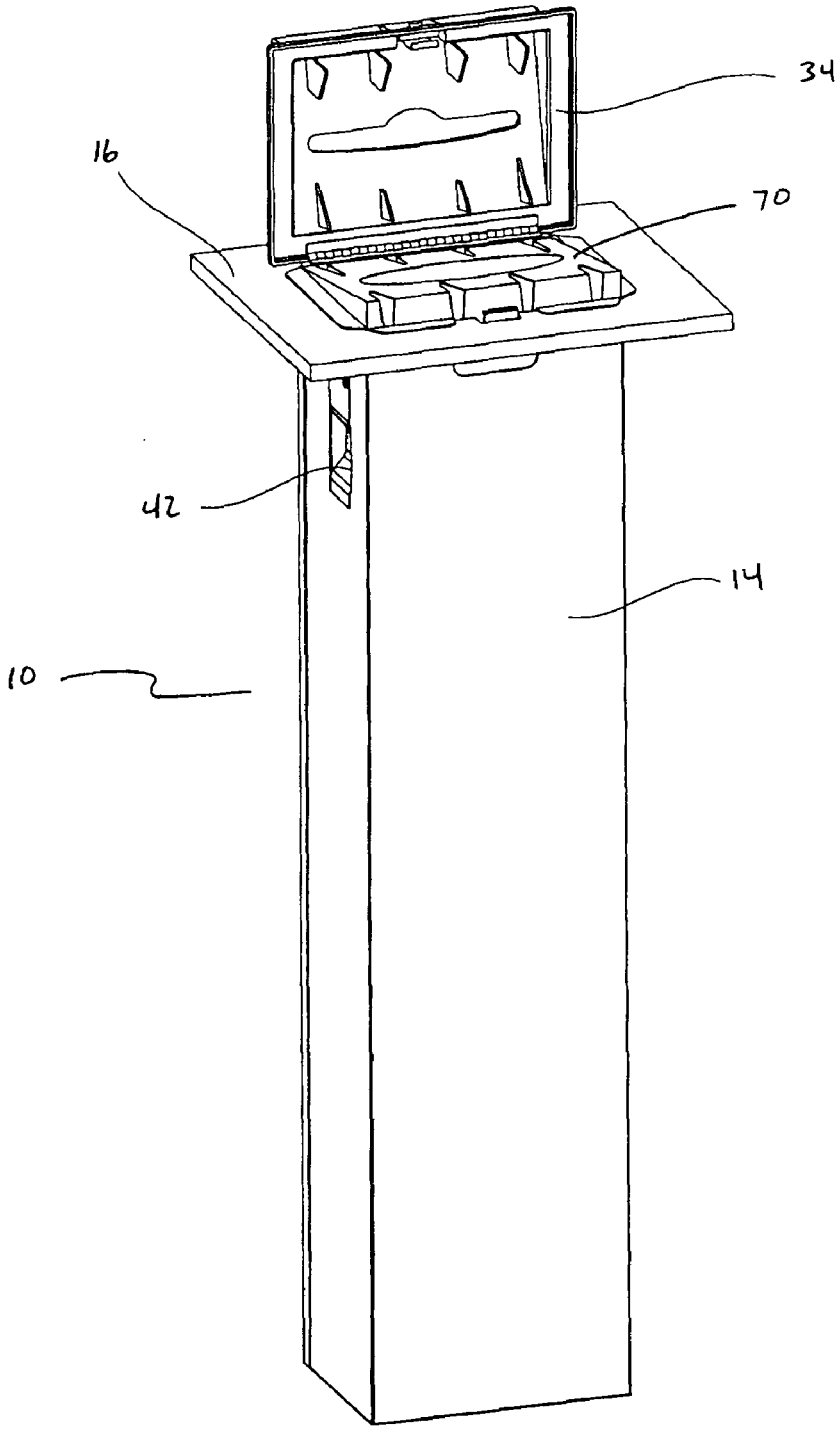
FIG. 4 is a perspective view of the container shown in FIG. 1 showing the cartridge in the container.

FIG. 4 is a perspective view showing the cartridge 70 fully inserted into the housing 14 mounted in the countertop 16.

Referring now to FIG. 5, a plunger 100 is disposed within the interior area 32 of the housing 14 along with at least one spring 102. When the spring 102 is compressed by the plunger 100, the spring 102 urges the plunger 100 in the dispensing direction 104. Thus, when paper products 12 are placed in the container 10 and the plunger 100 is depressed thereby compressing the spring 102, the plunger 100 and the spring 102 urge the paper products 12 toward the dispensing opening 40. Use of a plunger and spring mechanism allows the container 10 to be used in situations where paper products are to be dispensed in a substantially vertical direction.

The plunger 100 is shaped to provide support and lift the paper products 12 through the housing 14 without becoming stuck such that the paper products would no longer be elevated toward the dispensing opening 40. The plunger can have any one of various shapes. In one embodiment, the plunger 100 can take the shape of a truncated cone having a top surface 108 and a bottom surface 110. The top surface 108 engages and lifts an internal platform 82 against the paper products 12. The bottom surface 110 is engaged by the spring 102. The diameter of the bottom surface 110 is desirably substantially equivalent to the diameter of the spring 102. Desirably, the bottom surface 110 of the plunger is attached to the spring 102 to prevent disengagement of the spring from the bottom surface of the plunger.

Desirably, one or more stabilizing wings 112 extend from the plunger 100. The wings 112 act to distribute the force from the spring 102 to the outer edges of the internal platform 82. As shown in FIG. 2, the force is applied by the upper edge 114 of the wing 112 that contacts the internal platform 82. The wings 112 also act to prevent the plunger 100 and spring 102 from tipping over inside the cartridge. If the plunger 100 and spring 102 begin to tip over, the outer edge 116 of the wing 112 contacts the inside surface of the cartridge 70 before the plunger can get stuck. Thus, the surface area of the outer edge 116 is desirably minimized to prevent the outer edge from binding against the inside surface of the cartridge 70. The bevel 118 between the upper edge 114 and the outer edge 116 is configured to transition between the upper edge 114 and the outer edge 116. The wings 112 may have various thicknesses and the thickness of the wing may vary along any dimension or dimensions. Desirably, the outer edge 116 of the wing 112 will be relatively thin and smooth to minimize friction against the inside surface of the cartridge 70.

Referring again to FIG. 5, the spring 102 is sized to provide sufficient force to urge and/or elevate the paper products 12 to the dispensing opening 40. Desirably, the spring applies substantially constant pressure against the paper products at all positions of travel. Application of substantially constant pressure helps to prevent over application of force when the plunger is toward the bottom of the dispenser and under application of force when the plunger is toward the top of the dispenser.

As discussed above, prior to insertion of the cartridge into the housing, the bottom of the cartridge is opened to enable the contents of the cartridge to be engaged by the means for elevating the paper products. To prevent the paper products from falling out of the opening during the insertion process, the cartridge may contain an internal platform. The internal platform is prevented from falling out of the cartridge by platform supports attached to the internal surface of the cartridge. The platform rests unattached above the platform supports so that it will move with the means for urging and/or elevating the paper products as discussed above. The largest dimensions of the platform are slightly smaller than the internal dimensions of the cartridge so that the platform can move through the cartridge as paper products are dispensed without binding against the internal surface of the cartridge. Desirably, the largest dimensions of the platform are substantially equal to or slightly larger than the paper products to provide uniform dispensing of the paper products.

Figure 6:
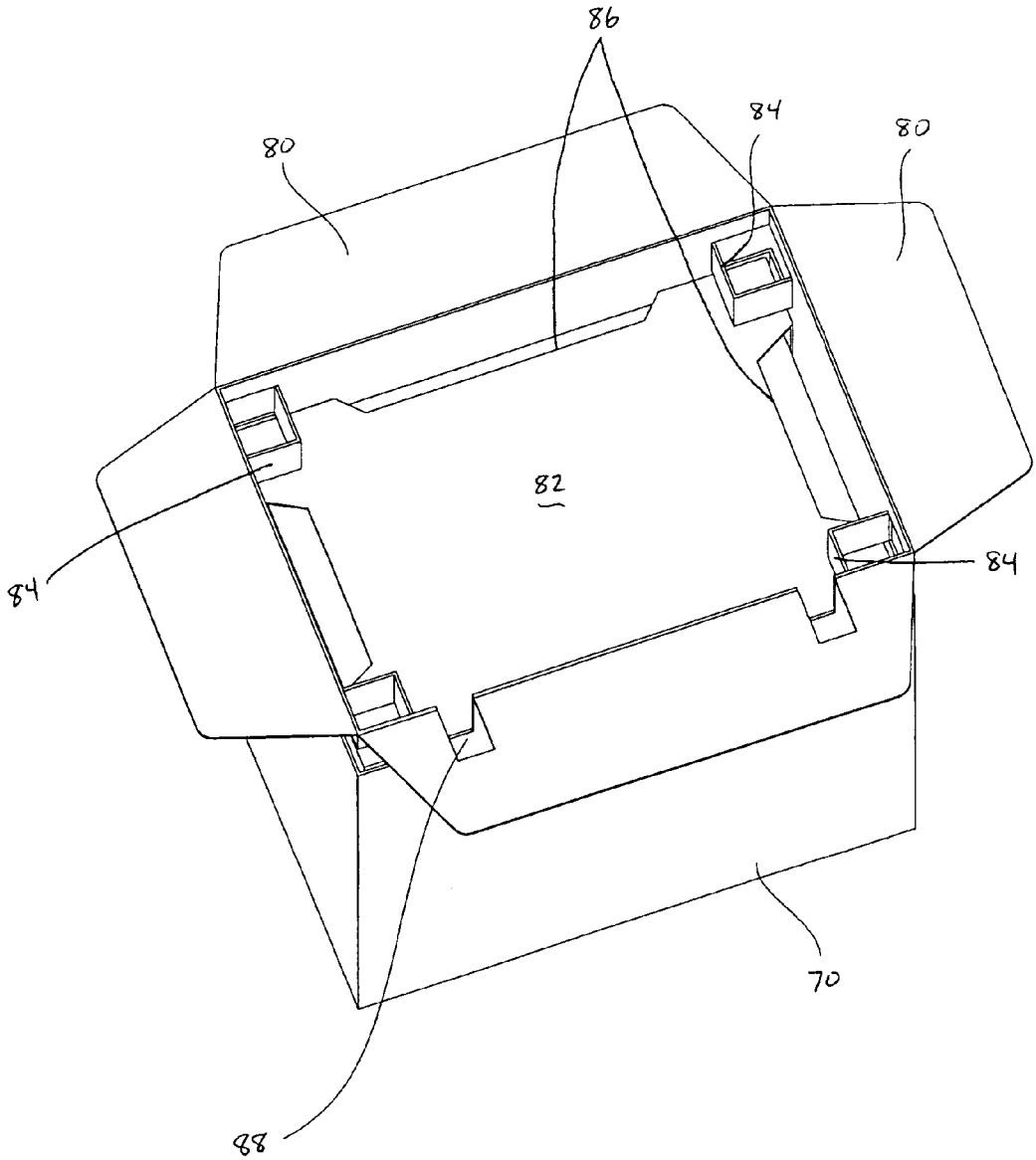
FIG. 6 is a perspective view of the open bottom portion of a cartridge for use with the container of FIG. 1.

FIG. 6. depicts a perspective view of the bottom end 74 of the cartridge 70. The flaps 80 are shown open, exposing the interior area of the cartridge 70. Platform supports 84 are depicted in FIG. 6 above the platform 82. Optionally, notches 86 are present in the sides of the platform to reduce contact of the platform 82 against the inside of the cartridge walls.

The platform supports may take any form, so long as the platform supports are large enough and sufficiently well attached to the interior surface of the cartridge to adequately support the weight of the paper products as the cartridge is being inserted into the housing. As one example, the platform supports may be separate components that are attached to the interior surface of the cartridge. As another example, the platform supports may be formed from partially removable portions in the side walls of the cartridge. At any time after the paper products and internal platform are loaded into the cartridge and before inserting the cartridge into the housing, the partially removable portions may be pressed into the interior of the cartridge to create the platform supports. At least a portion of the platform supports remain attached to the cartridge wall, thereby preventing the platform and paper products from falling from the cartridge when the cartridge is inverted to be loaded into the housing of the container.

It will be apparent to those skilled in the art that various modifications and variations can be made in the present invention without departing from the scope and spirit of the invention. It is intended that the present invention include such modifications and variations as come within the scope of the appended claims and their equivalents.

We claim:

1. A system for dispensing individual paper products, the system comprising:

a cartridge containing paper products; and a container;

where the container comprises:

a housing including side walls and a bottom wall defining an interior surface and an interior area within the interior surface;

a cover hingedly or removably attached to the housing wherein the cover defines a dispensing opening;

a spring disposed in the interior area of the housing; and a plunger disposed in the interior area of the housing wherein the spring is compressed between the plunger and at least one of the walls, and further wherein the plunger is urged toward the dispensing opening by the spring; and where the cartridge defines a second opening, the second opening being adapted for receiving the plunger wherein the plunger extends through the second opening into the interior area of the cartridge to contact the paper products and urge the paper products toward the dispensing opening.

2. The system of claim 1 wherein the plunger comprises a truncated cone.

3. The system of claim 2 wherein the truncated cone comprises a bottom surface having a diameter substantially equivalent to the diameter of the spring.

4. The system of claim 2 further wherein the plunger comprises at least one stabilizing wing.

5. The system of claim 4 wherein the at least one stabilizing wing has an outer edge that contacts the inside surface of the housing to prevent the plunger from binding in the housing.

6. The system of claim 1 further comprising an internal platform in contact with the plunger.

7. The system of claim 6 wherein the internal platform comprises notches to minimize contact of the internal platform with the internal surface of the housing.

8. The system of claim 6 further comprising paper products contained within the housing wherein the paper products are urged toward the dispensing opening by the internal platform.

9. The system of claim 8 wherein the internal platform applies substantially constant pressure against the paper products.

10. The system of claim 1 wherein the cartridge comprises cartridge side walls, a first end wall defining a third opening for dispensing the paper products, and a second end wall opposing the first end wall, wherein the second opening is defined by the second end wall.

11. The system of claim 10 wherein the cartridge further comprises an internal platform that engages the plunger.

12. The system of claim 11 wherein the cartridge further comprises platform supports, wherein the platform supports support the internal platform within the cartridge when the cartridge is being inserted in the housing.

13. The system of claim 1 wherein the cartridge further comprises a removable portion, removal of the removable portion creating the second opening.

14. The system of claim 13 wherein the removable portion comprises at least one flap.

15. The system of claim 1 wherein the container comprises tabs positioned on the interior surface of the housing, and further wherein the cartridge defines slots positioned to engage the tabs to prevent insertion of the cartridge when the cartridge is improperly oriented.

16. The system of claim 15 wherein the slots are defined within aside wall of the cartridge.

17. The system of claim 15 wherein the cartridge comprises flaps, wherein the flaps open to receive the plunger, and further wherein the flaps define the slots, and even further wherein the slots are positioned to engage the tabs when the flaps are open to receive the plunger and when the cartridge is improperly oriented.

18. The system of claim 1 wherein the spring applies substantially constant pressure against the paper products.

19. The system of claim 1 wherein the container is positioned within a supporting structure.

20. The system of claim 19 wherein the cover is flush with the supporting structure.

21. The system of claim 19 wherein the cover extends slightly from the supporting structure.

22. The system of claim 19 wherein the container is supported within the supporting structure by flanges intersecting the side walls at the edges farthest from the bottom wall.

23. The system of claim 19 wherein the paper products are urged toward the dispensing opening in substantially vertical direction.

24. A container for dispensing individual paper products, the container comprising:

a housing including side walls and a bottom wall defining an interior surface and an interior area within the interior surface for receiving a plurality of the paper products;

a cover hingedly or removably attached to the housing wherein the cover defines a dispensing opening;

a means for elevating paper products;

a plunger disposed in the interior area of the housing wherein the means for elevating paper products is positioned between the plunger and at least one of the walls, and further wherein the plunger is urged toward the dispensing opening, and a cartridge containing paper products, the cartridge defining a dispensing opening and a second opening wherein the means for elevating paper products extends through the second opening into the interior area of the cartridge to contact the paper products and urge the paper products toward the dispensing opening.

25. A container for dispensing individual paper products, the container comprising;

a housing including side wails and a bottom wall defining an interior surface and an interior area within the interior surface for receiving a plurality of the paper products, and a cover defining a dispensing opening for removal of paper products from the interior area, a spring-loaded plunger disposed in the interior area of the housing for elevating the paper products toward the dispensing opening, and a cartridge having an interior area containing paper products, the cartridge having a first end and a second end, the first end having a first opening for dispensing of paper products, the second end having a second opening through which the spring-loaded plunger extends into the interior area of the cartridge.

* * * * *